US007223299B2

(12) United States Patent
Kloeckener et al.

(10) Patent No.: US 7,223,299 B2
(45) Date of Patent: May 29, 2007

(54) COMPOSITION AND PROCESS FOR IMPROVING THE ADHESION OF A SICCATIVE ORGANIC COATING COMPOSITIONS TO METAL SUBSTRATES

(75) Inventors: James R. Kloeckener, Chesterfield, MO (US); Brian S. List, York, SC (US); Edward J. Reimbold, Atlanta, GA (US)

(73) Assignee: Atotech Deutschland GmbH, Berlin (DE)

( * ) Notice: Subject to any disclaimer, the term of this patent is extended or adjusted under 35 U.S.C. 154(b) by 644 days.

(21) Appl. No.: 10/653,878

(22) Filed: Sep. 2, 2003

(65) Prior Publication Data

US 2005/0048211 A1 Mar. 3, 2005

(51) Int. Cl.

| | |
|---|---|
| ***C23C 22/68*** | (2006.01) |
| ***C23C 22/83*** | (2006.01) |
| ***C23F 11/08*** | (2006.01) |
| ***C23F 11/10*** | (2006.01) |

(52) U.S. Cl. ..... 106/14.13; 106/14.41; 106/14.42; 106/14.44; 252/389.4

(58) Field of Classification Search ..... 106/14.13, 106/14.41, 14.42, 14.44; 252/389.4
See application file for complete search history.

(56) References Cited

U.S. PATENT DOCUMENTS

| | | | | |
|---|---|---|---|---|
| 2,999,064 | A | 9/1961 | Sluhan | 252/34.7 |
| 3,429,909 | A | 2/1969 | Schuster | 260/462 |
| 3,764,593 | A | 10/1973 | Schuster | 260/97.5 |
| 3,969,236 | A | 7/1976 | Waldstein | 252/49.5 |
| 4,022,713 | A | 5/1977 | Waldstein | 252/389 |
| 4,226,734 | A | 10/1980 | Schuster | 252/49.3 |
| 4,533,481 | A | 8/1985 | Jahnke | 252/49.6 |
| 4,675,125 | A | 6/1987 | Sturwold | 252/118 |
| 5,055,231 | A | 10/1991 | Hadamik et al. | 252/391 |
| 5,462,727 | A | 10/1995 | Engler | 424/45 |
| 5,795,373 | A | 8/1998 | Elmblad | 106/14.42 |
| H2014 | H | 2/2002 | Boulos et al. | 427/372.2 |
| 6,511,946 | B1 | 1/2003 | Theis et al. | 508/195 |

FOREIGN PATENT DOCUMENTS

| | | |
|---|---|---|
| DE | 1 620 447 | 4/1970 |
| EP | 0 015 442 A1 | 9/1980 |
| EP | 0 116 348 A2 | 8/1984 |
| JP | 52 000737 | 1/1977 |

OTHER PUBLICATIONS

Translation of DE1,620,447 (Apr. 1970).*
Written Opinion for International Application No. PCT/US2004/012257 mailed Sep. 9, 2005.

* cited by examiner

*Primary Examiner*—Anthony J. Green
(74) *Attorney, Agent, or Firm*—Renner, Otto, Boisselle & Sklar, LLP

(57) ABSTRACT

A composition is described which is useful in improving the adhesion of siccative organic coatings to metal surfaces. The composition generally comprises a liquid carrier, a borate composition which is the reaction product of at least one amino alcohol with boric acid or an analogue of boric acid, and, at least one organic carboxylic acid.

18 Claims, No Drawings

COMPOSITION AND PROCESS FOR IMPROVING THE ADHESION OF A SICCATIVE ORGANIC COATING COMPOSITIONS TO METAL SUBSTRATES

FIELD OF THE INVENTION

This invention relates to compositions useful in improving the adhesion of organic coating compositions to metal surfaces. More particularly, this invention relates to a composition and a process for improving the adhesion of paint to metal substrates.

BACKGROUND OF THE INVENTION

It is well known in the metal finishing art that metal surfaces such as aluminum, iron, steel, galvanized and zinc surfaces may be coated with an inorganic phosphate by contacting the surface with an aqueous phosphating solution. The phosphate coating protects the metal surface to a limited extent against corrosion and serves primarily as an excellent base for the later application of corrosion-inhibiting compositions and siccative organic coating compositions such as oils, waxes, paint, laquer, varnish, primers, synthetic resins, enamel, and the like.

The inorganic phosphate coatings generally are formed on a metal surface by means of aqueous solutions which contain phosphate ion, and optionally, certain auxiliary ions including metallic ions such as sodium, manganese, zinc, cadmium, copper, lead, and antimony ions. These aqueous solutions also may contain non-metallic ions such as ammonium, chloride, bromide, fluoride, nitrate, sulfate, and borate ions. These auxiliary ions influence the reaction with the metal surface, modify the character of the phosphate coating and adapt it for a wide variety of applications. Other auxiliary agents such as oxidizing agents, coloring agents and metal cleaning agents also may be incorporated in the phosphating solution.

Such phosphating solutions are well known in the art and are effective in improving the adhesion of paint to metal surfaces. Although the adhesion of the siccative organic coating to the metal surfaces is improved by the phosphate coating, it has been noted, for example, where ferrous metal, galvanized ferrous metal or phosphated ferrous metal parts are provided with a siccative top coat of laquer or enamel, and such top coat is scratched or scored during, for example, handling, forming or assembling operations, the metal substrate becomes a focal point for corrosion and for a phenomenon known as "undercutting". Undercutting, or the loosening of the top-coat and areas adjacent to a scratch or score causes a progressive flaking of the top-coat from the affected area. The undercutting also results in a reduction of the desirable corrosion-resistance properties.

In addition, phosphating solutions are necessarily highly acidic and thus require special handling and appropriate equipment. Sludge formation in the phosphating baths also can be problematic, and spent phosphating solutions and rinse waters require treatment prior to disposal to meet stringent state and local regulations pertaining to phosphate in effluent streams.

SUMMARY OF THE INVENTION

A composition is described which is useful in improving the adhesion of siccative organic coating compositions to metal surfaces, and the metal surface may be a phosphated metal surface or a non-phosphated metal surface. In one embodiment, the compositions of the present invention comprise (a) a liquid carrier, (b) at least one borate composition which is the reaction product of at least one amino alcohol and boric acid, or an analogue of boric acid, and, (c) one or more organic carboxylic acids.

In another embodiment, the invention relates to a process for improving the adhesion of a siccative organic coating composition to a metal surface which comprises (1) treating a metal surface with a treating composition comprising (a) a liquid carrier, (b) at least one borate composition which is the reaction product of at least one amino alcohol and boric acid or an analogue of boric acid; and, (c) at least one organic carboxylic acid, and (2) drying the treated metal surface.

DESCRIPTION OF THE EMBODIMENTS

The compositions of the present invention, in one embodiment, which are useful in coating metal surfaces, comprise a mixture comprising (a) a liquid carrier, (b) at least one borate composition which is the reaction product of at least one amino alcohol and boric acid or an analogue of boric acid, and, (c) at least one organic carboxylic acid.

The liquid carrier utilized in the compositions of the invention may comprise organic liquids (solvents), water, or mixtures thereof. In one embodiment, the liquid carrier utilized in the compositions of the present invention may be water or a mixture of water and one or more alcohols. Specific examples of useful alcohols include the lower alcohols (containing from 1 to 6 or more carbon atoms), as exemplified by methanol, ethanol, propanol, isopropanol, butanol, hexanol, etc. In one embodiment, the liquid carrier is selected to provide a solution comprising the borates and the organic carboxylic acids.

The borate compositions which are useful in the compositions of the invention generally comprise the reaction product of at least one amino alcohol with boric acid or an analogue of boric acid. The borate compositions which are useful are often referred to as boramides or amine borates. In one embodiment, the amino alcohols which are useful in the preparation of the borate compositions useful in the present invention may be alkanol amines or alkanol ether amines. A variety of amino alcohols may be utilized, and, in one embodiment, the amino alcohols contain from 1 to about 6 or more carbon atoms. Specific examples of such alkanol amines include mono alkanol amines such as methanol amine, 2-hydroxyethyl amine (monoethanol amine), 3-hydroxypropyl amine (monoisopropanol amine), 2-hydroxypropyl amine, 4-hydroxybutyl amine, 2-amino-2 methylpropanol, 5-hydroxypentyl amine, and 6-hydroxyhexyl amine. Examples of dialkanol amines include diethanol amine, dipropanol amine, and diisopropanol amine. An example of a trialkanol amine is triethanol amine.

In one embodiment, the alkanol ether amines useful in the present invention may be characterized by the formula $$[H(O—CHR—CH_2)_nOR']_mNR''_z \qquad \text{I}$$

wherein R is hydrogen or a lower alkyl group, R' is a lower alkylene group, n is an integer from 1 to about 5, m is 1, 2 or 3, and z is 3 minus m and R" is hydrogen or a lower alkyl group. In one embodiment, m is 2 and z is 1. In another embodiment, m is 1 and z is 2. Examples of alkanol ether amines as represented by formula II wherein m is 2 include dialkanol ether amines.

In another embodiment, the amino alcohol utilized in the preparation of the borate compositions is an monoalkanol ether amine which may be characterized by the formula $$H(O—CHR—CH_2)_nOR^1—NH_2 \quad \text{II}$$

wherein R is hydrogen or a lower alkyl group, $R^1$ is a lower alkylene group, and n is an integer from 1 to about 5. In one embodiment R is hydrogen or a methyl group, and n is 1 or 2.

As used herein, the term "lower alkyl", when used alone or in combination with other groups, is an alkyl group containing from 1 to about 6 carbon atoms. The term "lower alkyl" includes the straight-chain alkyl groups as well as the branched-chain alkyl groups. Specific examples of lower alkyl groups include methyl, ethyl, propyl, isopropyl, butyl, isobutyl, t-butyl, sec-butyl, pentyl, neopentyl, hexyl, etc. In one embodiment, the lower alkyl group contains from 1 to about 3 carbon atoms.

The term "lower alkylene" group, refers to an alkylene group containing from 1 to about 6 carbon atoms. The term includes straight chains as well as branched alkylene chains. Specific examples of alkylene groups include $—CH_2—$, $—CH_2—CH_2—$, $—CH(CH_3)CH_2—$, $—CH_2—C(H)(CH_3)—CH_2—$, etc. In one particular embodiment, the alkylene group contains from 1 to 3 carbon atoms.

Specific examples of alcohol ether amines as represented by Formula I include diglycolamine, triglycolamine, 2-(2-aminoethoxy)-ethanol, and 2-(3-aminopropoxy) ethanol.

The borate compositions utilized in the compositions of the present invention may be prepared by the reaction of at least one amino alcohol as described above with boric acid ($H_3BO_3$), or any one of its analogues, $HBO_2$, $H_2B_4O_7$ and $B_2O_3$. The reactants may be present in approximately equal molar proportions or with an excess of either of the reactants. Generally, if an excess of either of the components is used, an excess of the amino alcohol is used. In one embodiment, up to a molar excess or more of the amino alcohol can be utilized. The reaction between the amino alcohol and the boric acid or analogue of boric acid may take place under mild temperatures such as from about 100 to 180° C. Wide variations in the temperature of the reaction may be employed although, in one embodiment, a temperature range of from about 130° to about 165° C. is utilized. The water produced by the condensation reaction desirably is removed as the reaction proceeds, for example by heating in a closed vessel having a reflux condenser with an external collector. If desired, the residual water can be removed by solvent extraction.

The borate compounds prepared in the above manner are freely soluble in water and also soluble in substantially all organic liquids. Accordingly, it is possible to incorporate the borate compositions in various liquid carriers for various purposes.

The amount of borate composition present in the liquid carrier may range from about 0.01 to about 10% by weight based on the total weight of the borate composition and liquid carrier. In another embodiment, the concentration of the borate composition may range from about 0.05 to about 4% by weight, and yet in another embodiment, the amount may range from about 0.08 to about 2% by weight, based on the total weight of the borate composition and liquid carrier. In one embodiment the composition contains at least two borate compositions.

The borate compositions utilized in the present invention are available commercially and they have also been described in the literature. For example, U.S. Pat. Nos. 3,764,593; 3,969,236; 4,022,713; and 4,675,125 contain a number of examples of alkanolamide borates as well as a description of their preparation from boric acid and alkanol amines. U.S. Pat. No. 5,055,231 describes a number of alkanol etheramine borates and methods of preparing such borates from boric acid and alkanoletheramines. The disclosures of these patents are hereby incorporated by reference.

Useful amide borates are available commercially such as from Mona Industries, Inc. One example of a commercially available material is Monacor™ BE which is believed to contain equal amounts of monoethanolamine borate and monoisopropanolamine borate. Useful amine borates also are available from the Keil Chemical Division of Ferro Corp. Specific examples include Synkad 202, a diethanolamine borate, and Synkad 204, a triethanolamine borate.

The compositions of the invention also contain at least one organic carboxylic acid. Monocarboxylic and polycarboxylic acids may be utilized, and in another embodiment, the monocarboxylic and/or polycarboxylic acids are aliphatic carboxylic acids. The carboxylic acids may be saturated or unsaturated aliphatic carboxylic acids. Examples of monocarboxylic acids useful in the invention include acetic acid, propanoic acid, butanoic acid, pentanoic acid, hexanoic acid, heptanoic acid, octanoic acid, nonanoic acid, isonoic acid, dodecanoic acid, palmetic acid, stearic acid, etc. Examples of polycarboxylic acids useful in the invention include maleic acid, succinic acid, phthalic acid, adipic acid, trimellitic acid, and cyclohexane dicarboxylic acid. The corresponding anhydrides of the monocarboxylic (e.g., acetic anhydride) and polycarboxylic acids (e.g., succinic anhydride) also may be utilized in the invention. In one embodiment, mixtures of at least one monocarboxylic acid and at least one polycarboxylic acid are utilized. In one embodiment, the organic carboxylic acids utilized in the invention contain from 1 to about 20 carbon atoms, and in another embodiment, from 1 to about 10 carbon atoms.

The organic carboxylic acids are present in the compositions of the present invention in an amount ranging from about 0.01% to about 10% by weight based on the total weight of the composition. In another embodiment, the amount of carboxylic acid contained in the composition is in the range of from 0.03% to about 5% by weight, and yet in another embodiment, in the range of from about 0.05% to about 2% by weight based on the total weight of the composition.

The compositions of the present invention are easily prepared by mixing at least one borate compound and the organic carboxylic acid or acids in the liquid carrier. The order of mixing is not critical. Concentrates of the components may be prepared which are then diluted with additional liquid carrier. Aqueous solutions are obtained when the liquid carrier is water or a mixture of water and an alcohol such as methanol, ethanol, propanol, etc.

In one embodiment, the compositions of the invention are free of one or more added components such as triethanolamine; triethanolamine octoate; polyalkylene oxides such as polyethylene oxides, polypropylene oxides, ethylene oxide-propylene oxide polymers; alkyl benzoates; sulfonamide carboxylic acids; ethoxylated aliphatic alcohols or alkyl phenols; oxaethane carboxylic acids; and alkanolamine salts of fatty acids.

The following examples illustrate the preparation of compositions of the present invention. Unless otherwise indicated in the examples and elsewhere in the written description and claims, all parts and percentages are by weight, degrees are in centigrade and pressure is at or near atmospheric pressure. The compositions of Examples 1-6, 8-11 and 13-17 are solutions as mixed at about ambient temperature. Five drops of a 2% aqueous sodium hydroxide solution and 10 drops of a 2% aqueous sodium hydroxide solution are added to compositions 7 and 12 respectively to complete the solubilization of the components in water.

TABLE I

| Examples of Compositions (wt %) | | | | |
|---|---|---|---|---|
| Example | Monacor BE | Succinic Acid | Isononanoic Acid | Water |
| 1 | 0.09 | 0 | 0.06 | 99.85 |
| 2 | 0.06 | 0.02 | 0 | 99.92 |
| 3 | 0.06 | 0 | 0.03 | 99.91 |
| 4 | 0.09 | 0.02 | 0.03 | 99.86 |
| 5 | 0.09 | 0.04 | 0 | 99.87 |
| 6 | 0.12 | 0.04 | 0.03 | 99.81 |
| 7 | 0.09 | 0.04 | 0.04 | 99.83 |
| 8 | 0.12 | 0.02 | 0.06 | 99.80 |
| 9 | 0.09 | 0.02 | 0.03 | 99.86 |
| 10 | 0.12 | 0 | 0.03 | 99.85 |
| 11 | 0.06 | 0.02 | 0.04 | 99.88 |
| 12 | 0.06 | 0.03 | 0.03 | 99.88 |
| 13 | 0.09 | 0.02 | 0.03 | 99.86 |
| 14 | 0.09 | 0.02 | 0.03 | 99.86 |
| 15 | 0.12 | 0.02 | 0 | 99.86 |
| 16 | 0.09 | 0.02 | 0.03 | 99.86 |
| 17 | 0.09 | 0.04 | 0.03 | 99.84 |

In one embodiment, the compositions of the present invention are useful in improving the adhesion of a siccative organic coating composition to metal surfaces. Thus, in one embodiment, the present invention relates to a process for improving the adhesion of a siccative organic coating composition to a metal surface which comprises (1) treating a metal surface with a treating composition comprising (a) a liquid carrier, (b) at least one borate composition which is the reaction product of at least one amino alcohol and boric acid or an analogue or boric acid; and (c) at least one organic carboxylic acid (2) drying the treated metal surface.

The metal surfaces which can be treated in accordance with the present invention include aluminum surfaces, iron surfaces, steel surfaces, magnesium surfaces, magnesium alloy surfaces, galvanized iron surfaces, and zinc surfaces. It has also been observed that metal surfaces which have an inorganic phosphate coating (generally referred to as phosphated metal surfaces) may also be treated in accordance with the process of the present invention to improve the adhesion of siccative organic coating compositions to the phosphated metal surface.

In another embodiment, it has been discovered that improved adhesion of siccative organic coating compositions to metal surfaces which have not been phosphate coated can be obtained utilizing the treating compositions of the present invention.

In view of the extensive commercial development of the phosphating art and the many general publications and patents describing the preparation and application of phosphating solutions, it is believed unnecessary to lengthen this written description unduly by a detailed recitation of the many ways in which the application of metal phosphate coatings can be accomplished. It should be sufficient to indicate that any of the commonly used phosphating techniques such as spraying, brushing, dipping, roller-coating, or flow-coating may be employed, and that the temperature of the aqueous phosphating solution may vary within wide limits such as for example from room temperature to about 100° C. Generally, desirable results are obtained when the aqueous phosphating solution is used at a temperature within the range of from about 65° to about 100° C. The preparation and use of aqueous phosphating solutions for depositing inorganic phosphate coatings on metal surfaces is well known in the metal finishing art as illustrated in U.S. Pat. Nos. 3,104,177; 3,307,979; 3,364,081; and 3,458,364. The disclosures of these patents regarding inorganic phosphate coatings and procedures for using such coatings are hereby incorporated by reference.

The treating compositions of the present invention as described above may be applied to metal surfaces, including phosphated metal surfaces, by dipping, brushing, spraying, roller-coating, or flow-coating. Spraying or dipping are commonly utilized processes.

In one embodiment, the metal surface is initially cleaned by physical and/or chemical means to remove any grease, dirt, or oxides which may be present on the metal surface before the treating solution is applied to the metal surface. Cleaning solutions are known in the art and are generally aqueous solutions containing one or more of the following compounds: sodium hydroxide, sodium carbonate, alkali metal silicates, alkali metal borates, water softeners, phosphates, and active surface agents. Oxide removal may be accomplished with mineral acid pickles such as sulfuric acid, hydrochloric acid, and/or phosphoric acid.

Following cleaning, and generally rinsing with water, the metal surface is then contacted with the treating solutions of the present invention containing the borate compositions described above. The time required to treat the metal surfaces will vary according to the temperature, the type of solution being employed, the particular technique of applying the treating solution, and the coating weight desired. In one embodiment, the temperature of the treating solutions is ambient temperature. In most instances, the time required to produce the desired result will be within the range of from about 1 second to about 1 minute or more.

After the desired contact between the metal surfaces and the treating composition has been effected for the desired period of time, the treated panels are dried either in air or in a drying oven.

In another embodiment, the present invention relates to a process for improving the adhesion of a siccative organic coating to a metal surface which comprises the process of (1) cleaning the metal surface with one or more aqueous acidic or alkaline cleaning solutions;

(2) treating the metal surface with a treating composition comprising a liquid carrier, at least one borate composition which is the reaction product of at least one amino alcohol and boric acid or an analogue of boric acid, and, optionally, at least one organic carboxylic acid;

(3) drying the treated metal surface; and (4) depositing a siccative organic coating composition on the treated and dried metal surface.

As noted previously, the treating solution may comprise a mixture of two or more organic carboxylic acids, and at least two of the borate compositions.

A variety of siccative organic coating compositions may be deposited on the treated metal substrates of the present invention. Examples of siccative organic coatings which can be deposited include paint, laquer, varnish, synthetic resins, enamel or electrostatically deposited powder coatings. Examples of siccative coatings which may be used are the acrylic, alkyl, alkyd epoxy, phenolic, melamine, and vinyl resins and paints.

The application of a siccative organic coating composition can be effected by any of the ordinary techniques such as by brushing, spraying, dipping, roller-coating, flow-coating, or electrostatic or electrophoretic processes. The siccative coated article is dried in a manner best suited for the siccative coating composition employed such as by air-drying at ambient or elevated temperature, baking in an oven, UV curing, or baking under infrared lamps. In most instances, the thickness of the dried film of the siccative organic coating composition will be from about 0.1 to about 10 mils, and is more often between 0.3 to about 5 mils.

As noted previously, it has been discovered that the metal surfaces which have been treated with the treating compositions as described above improves the adhesion of the siccative organic coating composition to the metal.

In order to demonstrate the improved adhesion of siccative organic coating compositions to metal surfaces which have been treated with the compositions of the present invention, the following procedures are conducted. Steel panels (10 cm by×10 cm) are cleaned utilizing Uniclean™ BIO which is a mildly alkaline cleaner utilizing microorganisms for bioremediation. This product is available from Atotech USA, Inc., Rockhill, S.C. The test panels are cleaned in Uniclean™ BIO. (10% solution) for 5 minutes, rinsed with tap water for 15 seconds, rinsed with distilled water for 15 seconds, and thereafter immersed in the compositions of the present invention at ambient temperature as illustrated in Examples 1-17 for 30 seconds, drip dried and thereafter dried in a drying oven at a temperature of from about 165° to about 185° C.

A siccative organic coating composition is applied to the treated and dried panels electrostatically utilizing a powder coating available from TCI of Ellaville, Ga. under the trade designation Oyster White 19275. Duplicate unpolished steel panels are used in these tests. Iron phosphated panels which were purchased from ACT Laboratories, Hillsdale, Mich. also are included. These panels are labeled ACT Cold Roll Steel 04X06X032 B1000 NO Parcolene DIW; unpolished. Duplicates of each of the steel panels are used in the test, and the thickness of the paint is observed and recorded.

The painted and dried panels are subjected to a standard Salt Spray Corrosion Test. The test procedure and the apparatus used for this test are described in ASTM test procedure B-117. In this test, the treated and painted panels are scribed twice to form an X on the panel, each scribe being about 6 to 7 cm. The scribed panels are subjected to the salt spray test. The test utilizes a chamber in which a mist of spray of 5% aqueous sodium chloride is maintained in contact with the test panels for 168 hours at about 35° C. Upon removal of the panels from the test chamber, the panels are dried, and the scribe is blown with air at a pressure of about 70 psi which removes paint that lost adhesion as a result of the salt spray. The width of the paint loss is measured in millimeters (mm).

The results of the salt spray test conducted on steel panels treated with the treating compositions of the present invention prior to painting are summarized in the following Table II.

TABLE II

Salt Spray Test Results

| | Steel Panel Treated with Composition of | Paint Thickness (mils) | | Salt Spray Results (mm) | |
|---|---|---|---|---|---|
| Example | Example | Panel A | Panel B | Panel A | Panel B |
| A | 1 | 2.96 | 1.78 | 4–6 | 4–6 |
| B | 2 | 2.06 | 2.71 | 3–5 | 5–7 |
| C | 3 | 2.46 | 2.73 | 3–6 | 3–5 |
| D | 4 | 2.43 | 2.02 | 2–4 | 3–5 |
| E | 5 | 2.16 | 2.32 | 5–7 | 5–8 |
| F | 6 | 1.67 | 2.13 | 3–5 | 3–5 |
| G | 7 | 3.47 | 3.15 | 4–6 | 4–6 |
| H | 8 | 2.38 | 1.98 | 3–4 | 3–5 |
| I | 9 | 2.1 | 2.61 | 3–4 | 3–4 |
| J | 10 | 2.6 | 2.47 | 4–6 | 3–5 |
| K | 11 | 2.68 | 2.57 | 3–5 | 4–5 |
| L | 12 | 2.54 | 2.22 | 3–4 | 2–4 |
| M | 13 | 2.76 | 2.5 | 4–6 | 4–5 |
| N | 14 | 3.3 | 2.43 | 4–5 | 4–6 |
| O | 15 | 2.6 | 3.34 | 5–6 | 4–5 |
| P | 16 | 2.85 | 2.34 | 4–5 | 3–4 |
| Q | 17 | 2.6 | 1.73 | 4–6 | 3–5 |

The improvement which is obtained with the treating compositions of the present invention is illustrated in the following Table III. In Control-1, a commercial iron phosphate panel is rinsed with water, electrostatically painted as described above and subjected to the salt spray corrosion test. In Example R, the same iron phosphate panel is rinsed in deionized water, treated with the composition of Example 4 (via immersion for 30 seconds), dried and electrostatically painted as described above. In Control-2, a steel panel is cleaned with Uniclean™ BIO, rinsed with deionized water and electrostatically painted as described above. In Example S, the same steel panel is cleaned with Uniclean™ BIO, rinsed with deionized water, treated with the composition of Example 4 by immersion for 30 seconds, dried and electrostatically painted. The four painted panels (duplicates) were subjected to the salt spray corrosion test, and the results are summarized in Table III.

TABLE III

Salt Spray Test Results

| Example | Panel Type | Panel Treated with Composition of Example | Paint Thickness (mils) | | Salt Spray Results (mm) | |
|---|---|---|---|---|---|---|
| | | | Panel A | Panel B | Panel A | Panel B |
| Control-1 | Iron Phosphate | — | 3.32 | 3.17 | 3–5 | 3–5 |
| R | Iron Phosphate | 4 | 1.8 | 2.46 | 2–3 | 2–3 |
| Control-2 | Steel | — | 1.64 | 2.66 | 3–6 | 4–7 |
| S | Steel | 4 | 2.11 | 2.64 | 2–4 | 4–6 |

As can be seen from the results, treatment of an iron phosphate panel with the treating compositions of the present invention improves the adhesion of the paint to the phosphated panel as evidenced by comparing the results of Example R to the results obtained with Control-1. Also, treatment of an unphosphated steel panel with the treating compositions of the present invention followed by painting results in improved adhesion of the paint to the steel panel as evidenced by comparing the results of Example S to the results obtained with Control-2.

While the invention has been explained in relation to its various embodiments, it is to be understood that other modifications thereof will become apparent to those skilled in the art upon reading the specification. Therefore, it is to be understood that the invention disclosed herein is intended to cover such modifications as fall within the scope of the appended claims.

The invention claimed is:

1. A composition comprising (a) a liquid carrier, (b) at least one borate composition which is the reaction product of at least one amino alcohol and boric acid or an analog of boric acid, and (c) at least one organic aliphatic monocarboxylic acid and at least one organic aliphatic polycarboxylic acid.

2. The composition of claim 1 wherein the liquid carrier is an aqueous carrier.

3. The composition of claim 1 wherein the aqueous carrier comprises water or a mixture of water and at least one alcohol containing from 1 to about 6 carbon atoms.

4. The composition of claim 1 wherein the amino alcohol is an alkanol amine or an alkanolether amine.

5. The composition of claim 1 wherein the amino alcohol is an alkanol amine containing from 1 to about 6 carbon atoms.

6. The composition of claim 1 wherein the amino alcohol is an alkanol ether amine characterized by the formula $$[H(O—CHR—CH_2)_nOR']_mNR''_z \quad \text{I}$$

wherein R is hydrogen or a lower alkyl group, R' is a lower alkylene group, n is from 1 to about 5, m is 1, 2 or 3, z is 3 minus m, and R" is hydrogen or a lower alkyl group.

7. The composition of claim 1 wherein the amino alcohol is an alkanol ether amine characterized by the formula $$H(O—CHR—CH_2)_nOR'—NH_2 \quad \text{II}$$

wherein R is hydrogen or a lower alkyl group, R' is a lower alkylene group, and n is from 1 to about 5.

8. The composition of claim 7 wherein R' is selected from $—(CH_2)_2—$, $—(CH_2)_3—$ or $—CH(CH_3)—CH_2—$.

9. The composition of claim 1 wherein the amino alcohol is a primary alkanol amine containing from 1 to about 6 carbon atoms.

10. The composition of claim 1 wherein the amino alcohol is a primary alkanol amine selected from monomethanolamine, monoethanolamine, mono-n-propanolamine, 1-isopropanolamine, 2-amino-2-methyl-propanol and mixtures thereof.

11. A composition for improving the adhesion of siccative organic coatings to metal surfaces, said composition comprising (a) an aqueous carrier, (b) at least one borate composition which is the reaction product of at least one amino alcohol selected from alkanol amines and alkanol ether amines and boric acid or an analog of boric acid, and (c) at least one organic aliphatic monocarboxylic acid and at least one organic aliphatic polycarboxylic acid.

12. The composition of claim 11 wherein the amino alcohol is an alkanol amine containing from 1 to about 6 carbon atoms.

13. The composition of claim 11 containing from about 0.01% to about 10% by weight of the borate composition.

14. The composition of claim 11 containing from about 0.01% to about 10% by weight of the carboxylic acids.

15. A composition for improving the adhesion of siccative organic coatings to metal surfaces, said composition comprising (a) an aqueous carrier, (b) at least two borate compositions which are the reaction products of at least one amino alcohol selected from alkanol amines and alkanol ether amines and boric acid or an analog of boric acid, and (c) at least one organic carboxylic acid.

16. A composition comprising (a) a liquid carrier, (b) at least two borate compositions which are the reaction products of at least one amino alcohol and boric acid or an analog of boric acid, and (c) at least one organic aliphatic monocarboxylic acid and at least one organic aliphatic polycarboxylic acid.

17. A composition for improving the adhesion of siccative organic coatings to metal surfaces, said composition comprising (a) an aqueous carrier, (b) from about 0.01% to about 10% by weight of at least two borate compositions which are the reaction products of at least one amino alcohol selected from alkanol amines and alkanol ether amines and boric acid or an analog of boric acid, and (c) at least one organic aliphatic monocarboxylic acid and at least one organic aliphatic polycarboxylic acid.

18. A composition comprising (a) a liquid carrier, (b) at least two borate compositions which are the reaction products of at least one amino alcohol and boric acid or an analog of boric acid, and (c) at least one organic carboxylic acid.

* * * * *